US006915909B2

(12) United States Patent
Pillard

(10) Patent No.: US 6,915,909 B2
(45) Date of Patent: Jul. 12, 2005

(54) DEVICE FOR RECEIVING MULTI-FORMAT ENVELOPES

(75) Inventor: Romain Pillard, Nemours (FR)

(73) Assignee: Neopost Industrie, Bagneux (FR)

( * ) Notice: Subject to any disclaimer, the term of this patent is extended or adjusted under 35 U.S.C. 154(b) by 191 days.

(21) Appl. No.: 10/353,030

(22) Filed: Jan. 29, 2003

(65) Prior Publication Data

US 2003/0151193 A1 Aug. 14, 2003

(30) Foreign Application Priority Data

Jan. 30, 2002 (FR) ..... 02 01096

(51) Int. Cl.[7] ..... B07C 9/00
(52) U.S. Cl. ..... 209/659; 209/586; 209/900
(58) Field of Search ..... 209/900, 584, 209/586, 659

(56) References Cited

U.S. PATENT DOCUMENTS

| | | | | |
|---|---|---|---|---|
| 4,576,287 A | * | 3/1986 | Bingham et al. | 209/601 |
| 5,340,099 A | * | 8/1994 | Romanenko et al. | 271/303 |
| 5,364,090 A | | 11/1994 | Hollis et al. | |
| 5,464,317 A | | 11/1995 | Foster et al. | |
| 5,480,032 A | * | 1/1996 | Pippin et al. | 209/583 |
| 6,523,697 B1 | * | 2/2003 | Malatesta et al. | 209/656 |
| 6,666,450 B2 | * | 12/2003 | Slocum et al. | 271/218 |

FOREIGN PATENT DOCUMENTS

| | | |
|---|---|---|
| DE | 461684 | 6/1928 |
| DE | 1116601 | 11/1961 |
| FR | 670078 | 11/1929 |
| FR | 2 749 070 A1 | 1/1997 |

* cited by examiner

*Primary Examiner*—Donald P. Walsh
*Assistant Examiner*—Kaitlin Joerger
(74) *Attorney, Agent, or Firm*—Sughrue Mion, PLLC

(57) ABSTRACT

This invention relates to a device for receiving envelopes, or stacker, for a mail handling machine, comprising a conveyor belt arranged at the exit of the mail handling machine, for receiving these envelopes and conveying them perpendicularly to a direction of advance of these envelopes towards an inclined transfer surface from which these envelopes are then directed by guiding means mounted directly at the exit of the inclined transfer surface towards a first post storage bin of standard dimensions disposed beneath the conveyor belt. There is preferably provided, upstream of the conveyor belt, a motorized sorting flap adapted to be switched depending on the format of the franked mail item and which, in a first position, serves as support for the mail item when it is ejected towards the conveyor belt and, in a second position, forms an obstacle to the mail item which then drops loose directly in a second post storage bin disposed just at the exit of the mail handling machine.

8 Claims, 3 Drawing Sheets

DEVICE FOR RECEIVING MULTI-FORMAT ENVELOPES

FIELD OF THE INVENTION

The present invention relates to the domain of mail handling and more particularly to a device for receiving flat articles, or stacker, in a mail handling machine.

BACKGROUND OF THE INVENTION

Mail handling machines conventionally comprise three principal elements: a mail item feed device, a station for franking these mail items arranged at the exit of the feed device (incorporating a weighing device or not), and, arranged at the exit of the franking station, a receiving device, or stacker, for the mail items franked at the franking station. At the present time, these machines can frank mail items of any type and of any format and the receiving device must therefore be able to receive and store all these mail items correctly. This is why such devices are for the most part constituted by a simple receptacle in which the mail items of all formats are stored flat and loose in a pile of small capacity (about 100 envelopes of average thickness), as they are franked. Unfortunately, for high rates, for example around 10000 envelopes per hour (or about 3 envelopes per second), this configuration involves frequent stops of the machine and therefore of the franking of the mail items, when the franked mail items must be removed from the receptacle in order to be placed in post bins of which each presents a storage capacity of the order of 500 envelopes.

U.S. Pat. Nos. 3,945,635 and 5,464,317 disclose automatized stackers which employ conveyors, of the conveyor belt type, disposed lengthwise or perpendicularly at the exit of the franking station, and allowing storage by accumulation of the franked mail items in vertical position, and unloading, without stopping the machine. However, such devices present the drawback of being relatively cumbersome, the storage capacity of these devices essentially depending on the length of the conveyor. In addition, this solution does not dispense with placing these envelopes afterwards in post bins in order to facilitate subsequent handling thereof by the Postal Service.

It is an object of the present invention to provide a mail item receiving device, or stacker, which overcomes these drawbacks. One object of the invention is to propose a receiving device allowing unloading directly into post bins ready for dispatch. Another object of the invention is to allow a modulated reception of items depending on the format of the franked items. Yet another object of the invention is to provide a device which is as simple, compact and ergonomical as possible, while having a sufficient storage capacity, in particular one considerably greater than that of a simple receptacle.

SUMMARY OF THE INVENTION

These objects are attained by a device for receiving envelopes, or stacker, for a mail handling machine, comprising a conveyor belt arranged at the exit of the mail handling machine, for receiving these envelopes and conveying them perpendicularly to a direction of advance of these envelopes towards an inclined transfer surface from which these envelopes are then directed by guiding means mounted directly at the exit of the inclined transfer surface towards a first post storage bin of standard dimensions disposed beneath the conveyor belt, and guiding means associated with the inclined transfer surface are provided to guide the envelopes in their descent towards the first post storage bin.

With this configuration, it thus becomes possible to store a larger quantity of envelopes and to present them directly in a position able to be exploited by the Postal Service.

The guiding means comprise two slideways mounted on either side of the inclined transfer surface and intended to ensure a guiding of the sides of the envelopes. A frame is applied on the first post storage bin, comprising two parallel guides on which a divider is suspended, intended to change position as the envelopes are received.

Another post storage bin is preferably arranged beneath the first, intended to be substituted for the latter by an operator when the first post storage bin is full.

According to another form of embodiment, the device according to the invention comprises, upstream of the conveyor belt, a motorized sorting flap adapted to be switched depending on the format of the franked envelope and which, in a first position, serves as support for this envelope when it is being ejected towards the conveyor belt and, in a second position, forms an obstacle to the envelope which drops loose directly into a second post storage bin arranged just at the exit of the mail handling machine.

The first position advantageously allows the passage of envelopes of format C6/5 towards the first post storage bin, the second position directing the envelopes of all the other formats towards the second post storage bin, the position of the sorting flap being switched by a control motor as a function of the format information delivered by the envelope length detection means available at the level of the mail handling machine.

According to another form of embodiment, the second post storage bin intended for receiving the non-sorted envelopes is replaced by a conveyor belt allowing an edgewise accumulation of these envelopes.

BRIEF DESCRIPTION OF THE DRAWINGS

The invention will be more readily understood on reading the following description given by way of non-limiting example, with reference to the accompanying drawings, in which.

DESCRIPTION OF PREFERRED EMBODIMENTS

Figure 1:
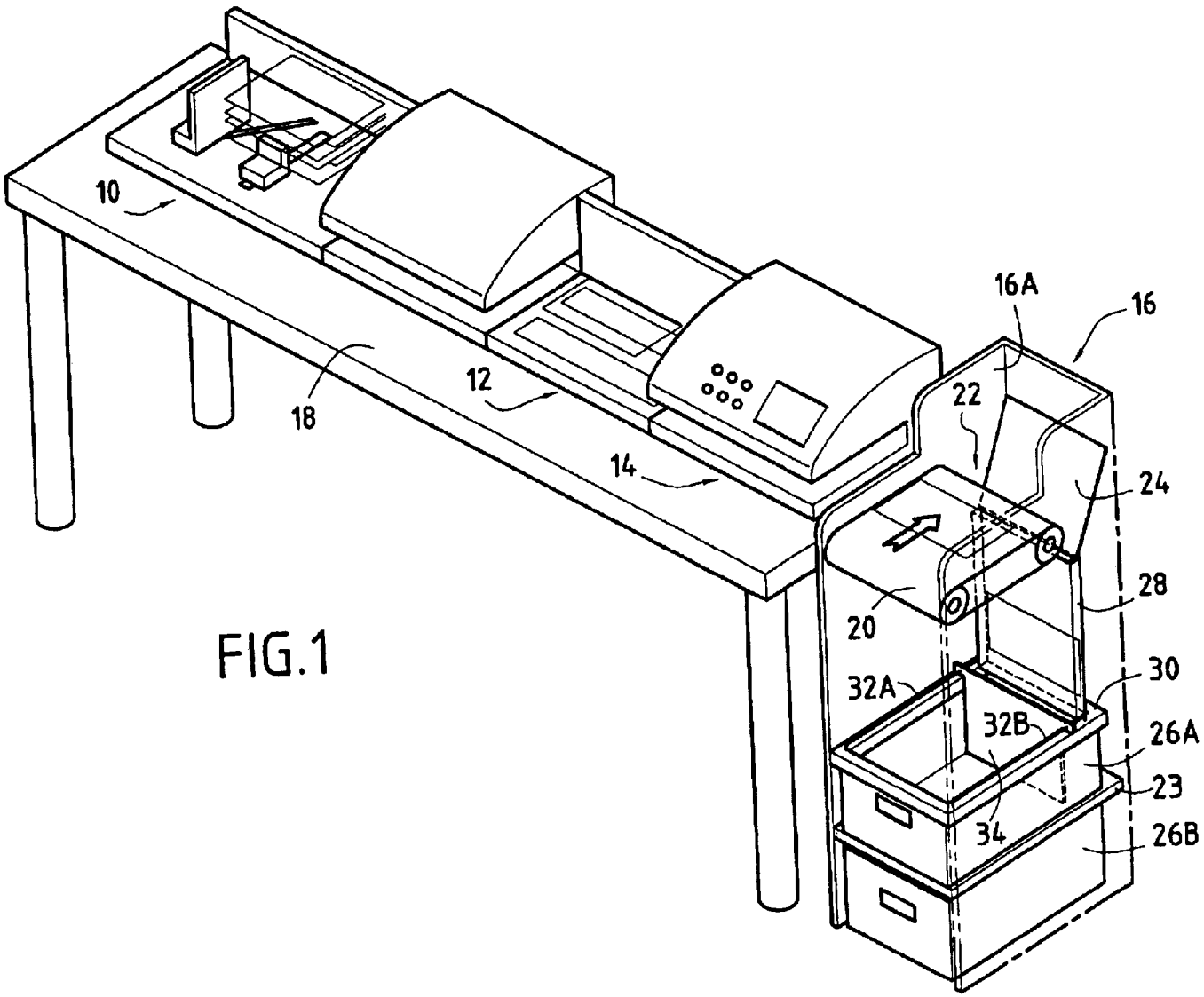
FIG. 1 is a view in perspective of a mail handling machine comprising a first embodiment of a receiving device, or stacker, according to the invention.

Referring now to the drawings, a first form of embodiment of a mail item receiving device, or stacker, of a mail handling machine, is illustrated in FIG. 1.

This mail handling machine conventionally comprises, from upstream to downstream with respect to the direction of advance of these items: a mail item feeder 10, a dynamic weighing module 12, a franking station 14 and, arranged at the exit of this station, a receiving device, or stacker 16, for the franked mail items. All these elements are located on a work table 18 or arranged on one of its sides in order to be easily available to an operator in charge of the franking operations and generally in position in front of this table.

Such a machine can frank mail items of different formats, from American format No. 5 (76.2 mm*127 mm) up to European format b4 (250 mm*353 mm), via standard European format C6/5 (114 mm*229 mm) up to a determined thickness, for example 16 mm, corresponding to the height of the slot in the machine for introduction of the mail items.

According to the invention, the receiving device comprises a first module (or column 16A) comprising a conveyor belt 20 for successively receiving the mail items ejected by the franking station 14 of the machine and conveying them towards the rear of the work table (in order to clear the front of the work table for the operator) perpendicularly to their direction of ejection (which is also the direction of advance of these items) towards an opening 22 in which they will drop one by one in order to be directed along an inclined surface 24 which ensures transfer of these items towards a first post storage bin 26A of standard dimensions, for example 300*492*194, arranged in the column beneath the conveyor belt on a shelf 23 of the module. Such inclination of the transfer surface makes it possible to straighten up the mail items which were initially in a horizontal position and therefore to stow them vertically (edgewise) in the post bin (this vertical position is required by the Postal Service in order to facilitate the subsequent sorting operations carried out by this Administration). To allow easy arrangement and to guide the envelopes in their descent towards the post bin 26A, the receiving device comprises a guiding gutter 28 mounted directly at the exit of the inclined surface and whose width corresponds to the largest format of the franked envelopes. This gutter is associated with a frame 30 intended to be applied on the upper peripheral edge of the post bin and comprising two parallel guides 32A, 32B on which is suspended a divider 34 intended to change position as the envelopes are received and therefore as the bin is filled. It will be noted that, in order to limit the time of interruption of the franking process, the receiving device preferably comprises two superposed post bins 26A, 26B. In this way, once it is full, the operator can remove the corresponding bin from the module (such removal may be facilitated by replacing the shelf 23 by a drawer on runners), take off the frame which surmounts it (a flat spiral spring system may in that case allow, for example, the divider to return into its initial position), and place it on the second empty bin which can be positioned in place of the first bin in order to continue the franking process. It will be noted that it is possible to provide a visual or sound sensor (not shown) on the frame and/or the divider to warn the operator of the presence of a full bin.

With this configuration, the subsequent work of the Administration is thus largely facilitated as, on the one hand, the mail items are transmitted thereto in post bins of standard dimensions and, on the other hand, these mail items are in a vertical position, facilitating insertion thereof in automatized sorting machines. However, it will be noted that this configuration does not allow the mail items which emerge loose from the franking station 14, to be sorted as a function of their formats.

Figure 2:
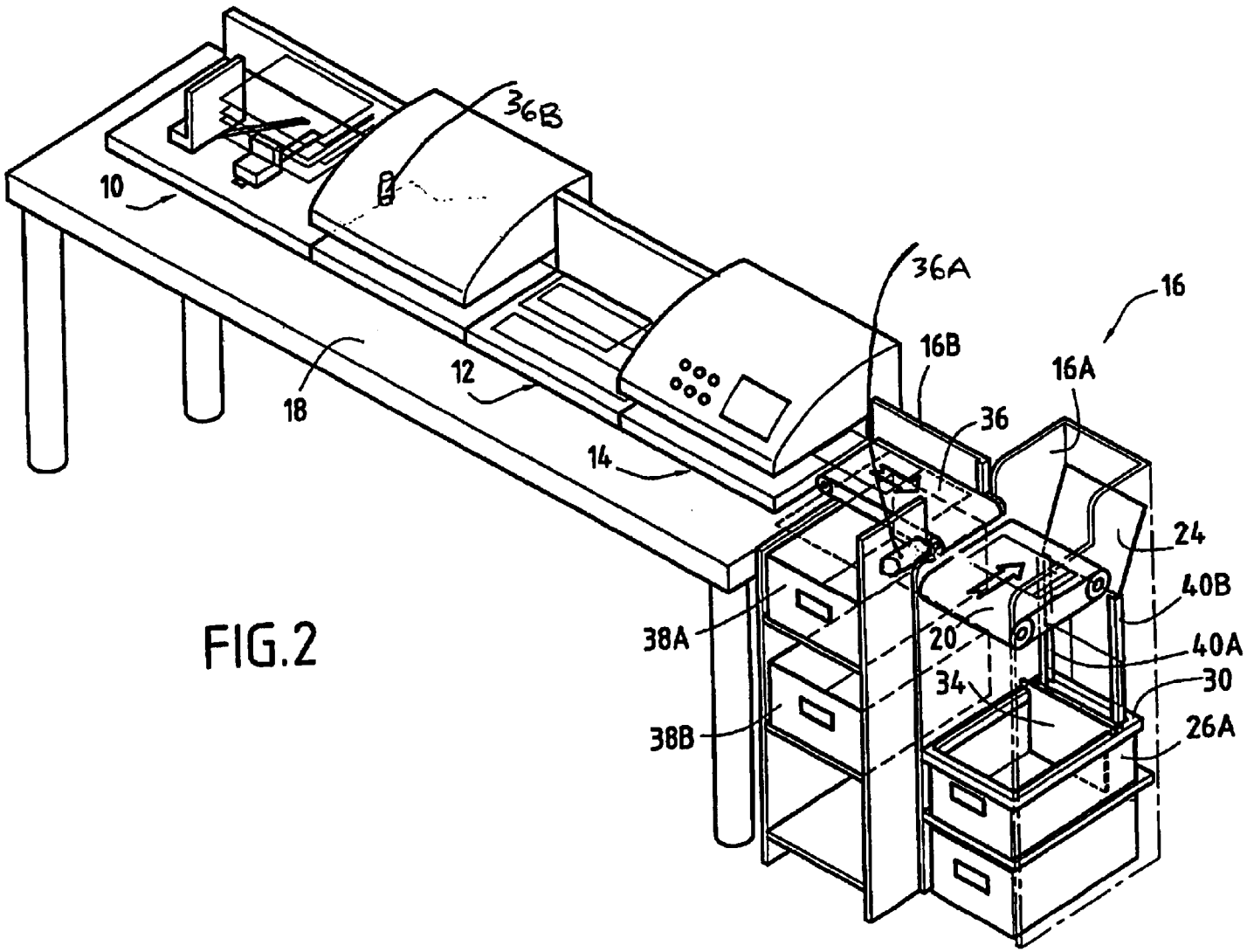
FIG. 2 is a view in perspective of a mail handling machine comprising a second embodiment of the receiving device according to the invention.

This is the object of the configuration illustrated in FIG. 2, of which identical elements bear the same references and which presents the advantage over the preceding configuration of allowing a first sorting of the mail items having a predetermined format, preferably the format most currently used, for example format C6/5 in Europe.

To that end, the receiving device comprises a second module (or column 16B) arranged upstream of the first and comprising a motorized sorting flap 36 able to switch positions depending on the format of the franked mail item and which, in a first position, serves as support for the mail item when it is ejected towards the conveyor belt 20 and, in a second position, forms an obstacle to the mail item which in that case drops loose directly in a second post bin 38A arranged just at the exit of the franking station 14. The first position is advantageously chosen to allow the passage only of the mail articles of format C6/5 towards the first post bin 26A whose dimensions correspond to these mail items, the second position being used for the items of all the other formats (non-sorted mail items) which drop directly into the second post bin 38A of standard dimensions 298*280*492. Due to the perfect match between the mail items and the post bin having to receive them, the gutter 28 may be replaced by two simple slideways 40A, 40B mounted on either side of the inclined transfer surface 24 and guiding the sides of the envelopes. The sorting flap 36 switches position by means of a control motor 36A as a function of format information delivered by means detecting the length of the envelopes 36B available at the franking station of the mail handling machine.

As in the preceding configuration, it is preferably provided, for handling non-sorted mail items, i.e. of formats other than format C6/5, to superpose two post bins 38A, 38B so as to facilitate the operations of unloading by the operator. The frequency of filling of this bin compared to the other non-current formats being relatively low, it can be removed and replaced by the empty bin disposed therebeneath, by hand, during the handling of the mail items of format C6/5, therefore without the machine stopping.

Figure 3:
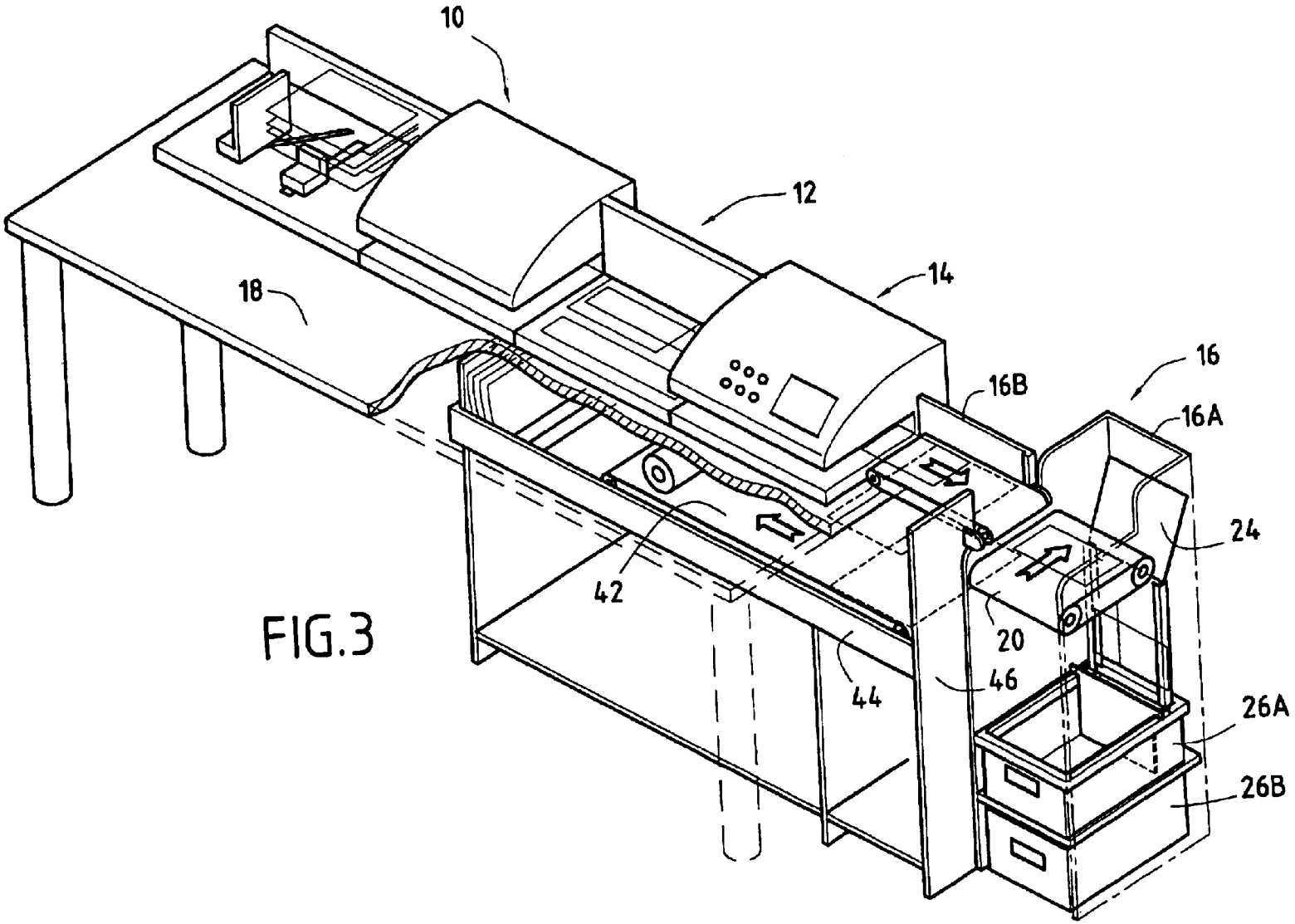
FIG. 3 is a view in perspective of a mail handling machine comprising a third embodiment of a receiving device according to the invention.

FIG. 3 shows a third form of embodiment of a mail item receiving device according to the invention, in which the second post bin 38A intended for receiving the non-sorted mail items, is replaced by a conveyor belt 42 mounted under the work table 18 on a lower deck 44. This conveyor, whose direction of conveyance is opposite that of advance of the mail items on the table, is of known type, for example as disclosed by U.S. Pat. No. 5,464,317, allowing an edgewise accumulation of the mail items, i.e. in a vertical position facilitating subsequent handling thereof by automatized post handling machines. As in the preceding configuration, the plane of separation 46 between the two modules 16A, 16B forms a stop for the items whose format exceeds that handled by the module 16A for receiving the sorted items.

What is claimed is:

1. Device for receiving envelopes, or stacker, for a mail handling machine, comprising a conveyor belt arranged at the exit of the mail handling machine, for receiving these envelopes and conveying them perpendicularly to a direction of advance of these envelopes towards an inclined transfer surface from which these envelopes are then directed edgewise by guiding means mounted directly at the exit of the inclined transfer surface towards a first post storage bin of standard dimensions disposed beneath the conveyor belt and adapted to receive the envelopes in a vertical position.

2. The device of claim 1, wherein said guiding means comprise two slideways mounted on either side of the inclined transfer surface and intended to ensure a guiding of the sides of the envelopes.

3. The device of claim 1, wherein it further comprises a frame applied on the first post storage bin, comprising two parallel guides on which a divider is suspended, intended to change position as the envelopes are received.

4. The device of claim 3, wherein it further comprises another post storage bin arranged beneath the first, intended to be substituted for the latter by an operator when the first post storage bin is full.

5. The device of claim 1, wherein it further comprises, upstream of the conveyor belt, a motorized sorting flap adapted to be switched depending on the format of the franked envelope and which, in a first position, serves as support for this envelope when it is being ejected towards the conveyor belt and, in a second position, forms an obstacle to the envelope which drops loose directly into a second post storage bin arranged just at the exit of the mail handling machine.

6. The device of claim 5, wherein first position allows the passage of envelopes of format C6/5 towards the first post storage bin, the second position directing the envelopes of all the other formats towards the second post storage bin.

7. The device of claim 5, wherein the position of the sorting flap is switched by a control motor as a function of format information delivered by the envelope length detection means available at the level of the mail handling machine.

8. The device of claim 5, wherein the second post storage bin intended for receiving the non-sorted envelopes is replaced by a conveyor belt allowing an edgewise accumulation of these envelopes.

* * * * *